US006004154A

United States Patent [19]

O'Brien

[11] Patent Number: 6,004,154

[45] Date of Patent: Dec. 21, 1999

[54] LOW VOLTAGE DECK LIGHT

[75] Inventor: Steven T. O'Brien, Brooklyn Park, Minn.

[73] Assignee: The Toro Company, Bloomington, Mo.

[21] Appl. No.: 09/164,805

[22] Filed: Oct. 1, 1998

[51] Int. Cl.[6] ..... H01R 4/24

[52] U.S. Cl. ..... 439/419; 439/937

[58] Field of Search ..... 439/419, 417, 439/425, 414, 577, 578, 937

[56] References Cited

U.S. PATENT DOCUMENTS

| | | | |
|---|---|---|---|
| 4,768,139 | 8/1988 | Poppenheimer | 362/302 |
| 4,774,648 | 9/1988 | Kakuk et al. | 362/302 |
| 4,826,448 | 5/1989 | Maddock | 439/409 |
| 5,001,611 | 3/1991 | Beachy et al. | 362/145 |
| 5,398,180 | 3/1995 | Lee | 362/431 |
| 5,660,561 | 8/1997 | Tseng | 439/419 |
| 5,800,211 | 9/1998 | Stabile | 439/578 |

*Primary Examiner*—Neil Abrams
*Assistant Examiner*—Javaid Nasri
*Attorney, Agent, or Firm*—Donald S. Trevarthen

[57] ABSTRACT

A light fixture includes a lamp contact supported by the fixture and a lamp electrically connected to the lamp contact. The light fixture also includes an electrical supply cable for delivering electrical power to the lamp contacts and lamp. The light fixture also includes a breakaway cable connector connected to the light fixture by a tab and a cable connector receiver formed in the fixture for receiving and mechanically restraining the cable connector. The lamp contacts are electrically connected to the cable when the cable is positioned on the light fixture and the cable connector is broken off of the light fixture and snapped into the cable connector receiver.

9 Claims, 9 Drawing Sheets

LOW VOLTAGE DECK LIGHT

FIELD OF THE INVENTION

This invention relates to light fixtures. More specifically, the preferred embodiment of this invention includes a low voltage outdoor lighting fixture and a unique system for connecting light bulb contacts to electrical supply cable.

BACKGROUND OF THE INVENTION

Low voltage outdoor lights are well known among homeowners and landscape contractors. Such lighting is typically used for outdoor decorative lighting to highlight landscaping and various architectural features of homes or buildings.

There are many different styles of low voltage outdoor lights. One variety of lights is designed to be secured to the ground by means of a stake. Typically, the electrical supply cable for such ground type lights is buried underground in soil. The electrical supply cable runs from a remote power supply (typically a 120 volt AC to 12 volt AC transformer) to each light.

A second style of low voltage outdoor lighting is a deck light. Deck lights are designed to be mounted well above ground on such structures as decks or porches. A deck light includes means for mounting the fixture to the deck or porch structure. Typical mounting means include wood screws and apertures within the light fixture for accepting the wood screws which are screwed into the deck. Deck lights also include means for electrically connecting a light bulb or lamp to an electrical supply cable where the cable delivers power from a remote power supply.

Most low voltage outdoor lights have means for connecting the electrical power supply cable to the light fixture and its lamp. One way of connecting the electrical supply to the lamp is shown in U.S. Pat. No. 5,001,611 to Beachy et al. and assigned to The Toro Company, assignee of the present application. The '611 patent discloses an electrical supply cable connected to a pair of lamp contacts wherein the contacts snap onto the light fixture. The lamp contacts engage and electrically connect a lamp which protrudes into the deck light fixture of the '611 patent.

U.S. Pat. No. 4,774,648 issued to Kakuk et al. and assigned to The Toro Company discloses a low voltage outdoor light fixture wherein the electrical supply cable is connected to lamp contacts and the light bulb via a slide on connector system. The slide on connector includes a set of male cable prongs on the light fixture and a female adapter on the top of the supporting post/stake. The male cable prongs pierce the electrical supply cable insulation and make contact with the conductive cable core when the slide on connector is slid onto the post/stake.

U.S. Pat. No. 4,826,448 to Maddock discloses a low voltage lighting fixture with a cam type fastener that acts as a means for pressing electrical cable against piercing type lamp contacts causing the piercing contacts to penetrate the insulation and make electrical contact between the contacts and the conductive cores of the cable.

U.S. Pat. No. 4,768,139 to Poppenheimer discloses a low voltage lighting fixture wherein the upper portion of the fixture includes a lamp and a set of lamp contacts which extend downwardly. The light fixture also includes a lower portion (including a ground engaging stake) through which an electrical cable runs. Electrical contact is achieved between the upper portion and its lamp contacts and the lower portion and the conductive cores of the electrical cable when the top portion is pressed down, in a sliding manner, over the lower portion.

U.S. Pat. No. 5,398,100 to Lee discloses a low voltage light fixture that includes an upper portion with a lamp and a pair of lamp contacts. The light fixture also includes a lower portion (including a ground engaging stake) through which an electrical cable runs. A connector is configured for assembly between the upper portion and the lower portion, wherein the connector includes means for receiving and retaining a pair of cable piercing contacts. The lamp fixture is assembled by placing the lamp contacts and the lamp into the upper portion. The cable piercing contacts are inserted into the connector and the connector is then positioned between the lower portion and the upper portion. Electrical contact is achieved between the lamp and the conductive cores of the electrical cable when the upper portion is pressed down onto the lower portion and the interposed connector.

The present invention offers an alternative low voltage outdoor light with a unique system for connecting light bulb contacts to electrical supply cable. In particular, a preferred light fixture according to the present invention incorporates a lamp contact supported by the fixture, a lamp electrically connected to the lamp contact, an electrical supply cable for delivering electrical power to the lamp contact and lamp, a breakaway cable connector connected to the light fixture, and a cable connector receiver formed in the fixture for receiving and mechanically restraining the cable connector.

SUMMARY OF THE INVENTION

The present invention includes a light fixture including a lamp contact supported by the fixture, a lamp electrically connected to the lamp contacts, an electrical supply cable for delivering electrical power to the lamp contacts and lamp, a breakaway cable connector connected to the light fixture by a tab, and a cable connector receiver formed in the fixture for receiving and mechanically restraining the cable connector wherein the lamp contacts are electrically connected to the cable when the cable positioned on the light fixture and the cable connector is broken off of the light fixture and snapped into the cable connector receiver.

The present invention may also include a light fixture with a pair of lamp contacts operatively supported by the fixture, a lamp mechanically and electrically connected to the lamp contacts, an electrical supply cable for delivering power to the lamp contacts and lamp, a channel formed in the light fixture for accepting the electrical supply cable, a breakaway cable connector connected to the light fixture, and a cable connector receiver formed in the fixture for receiving and mechanically restraining the cable connector wherein the lamp contacts are electrically connected to the cable when the cable is positioned in the channel and the cable connector is broken off of the light fixture and snapped into the cable connector receiver.

The light fixture of the present invention may also include a breakaway cable connector with at least one barbed leg for engaging the connector receiver. The breakaway connector can be a generally U-shaped element with a pair of barbed legs for engaging the connector receiver.

The breakaway cable connector may be connected to the light fixture by a tab wherein the tab breaks away from the connector or the fixture when a force exceeding a predetermined value is transmitted through the tab. The junction between the fixture and the tab can include a notch running along the intersection of the tab and the fixture. Likewise, the junction between the connector and the tab can include a notch.

BRIEF DESCRIPTION OF THE DRAWINGS

The invention will be further described with reference to the appended Drawing, in which.

DETAILED DESCRIPTION OF THE PREFERRED EMBODIMENT

Figure 1:
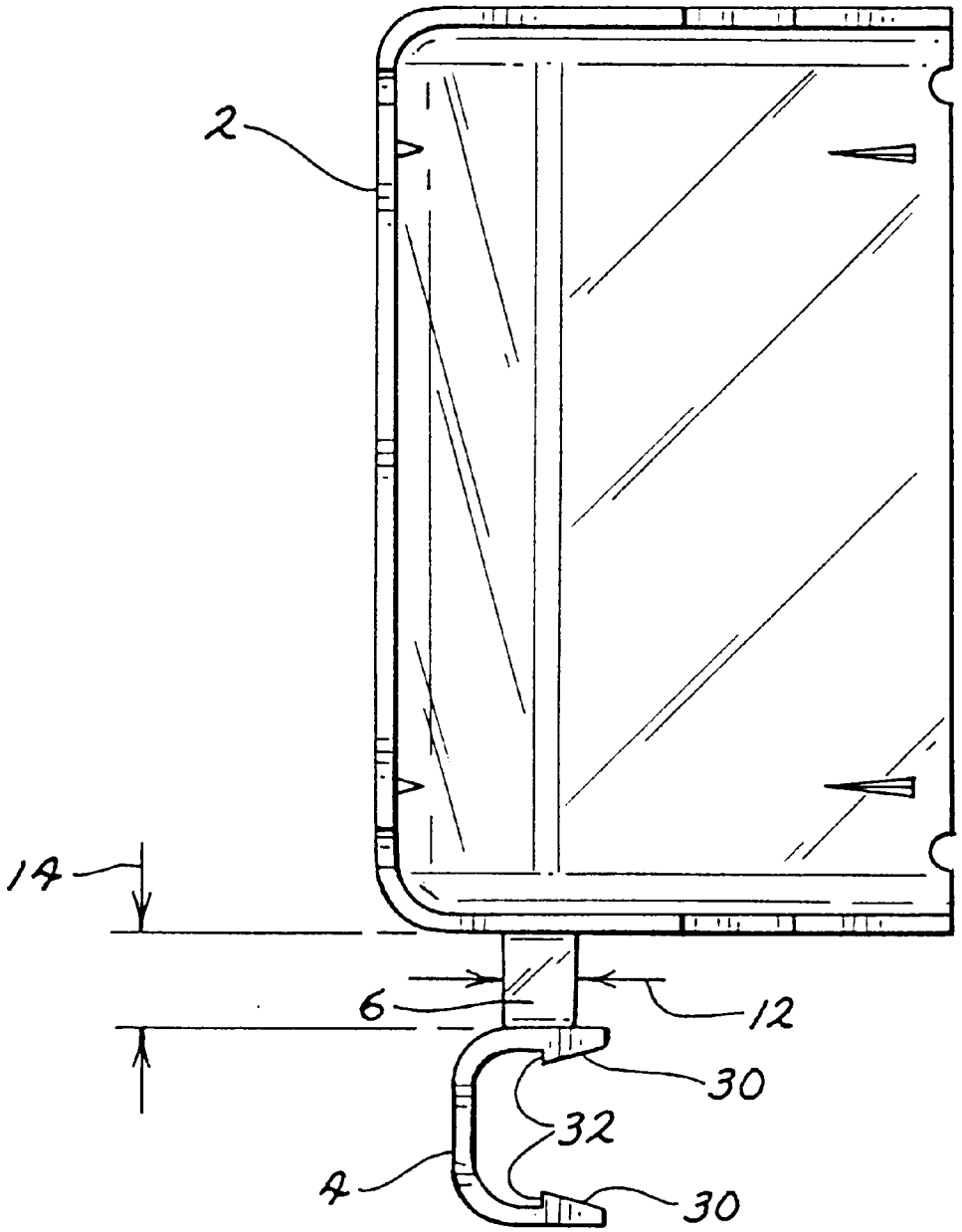
FIG. 1 is a top plan view of the lens of the preferred light fixture of the present invention.
Figure 2:
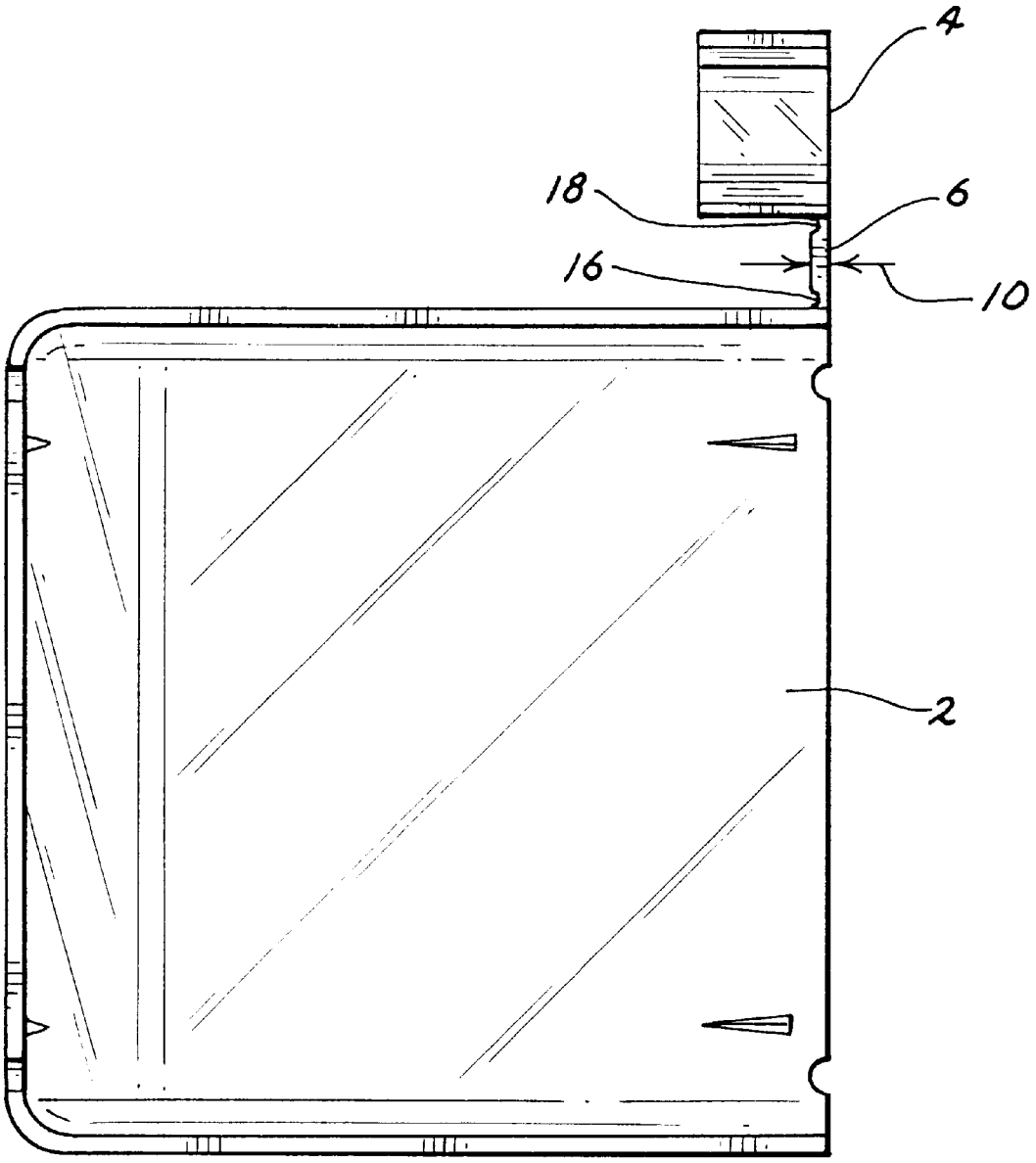
FIG. 2 is a rear elevational view thereof.
Figure 3:
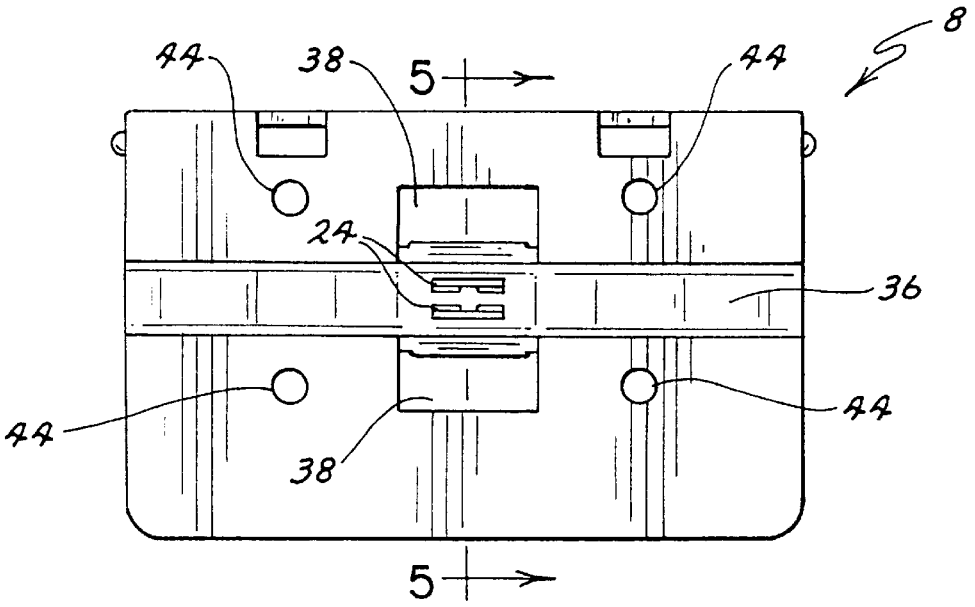
FIG. 3 is a top plan view of the backplate of the preferred light fixture of the present invention.
Figure 7:
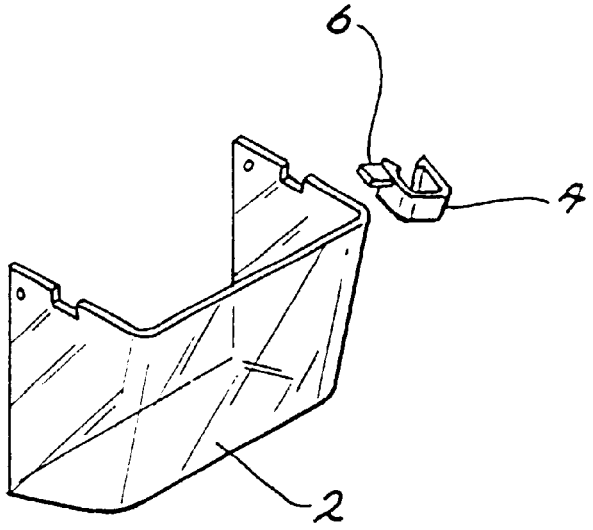
FIG. 7 is an exploded view of the lens, cable connector and tab showing the cable connector and tab removed from the lens.
Figure 8:
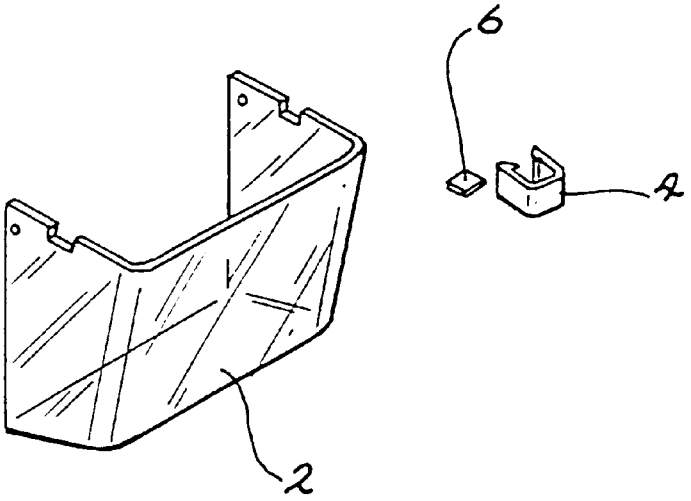
FIG. 8 is an exploded view of the lens, cable connector and tab showing the cable connector removed from the tab.
Figure 12:
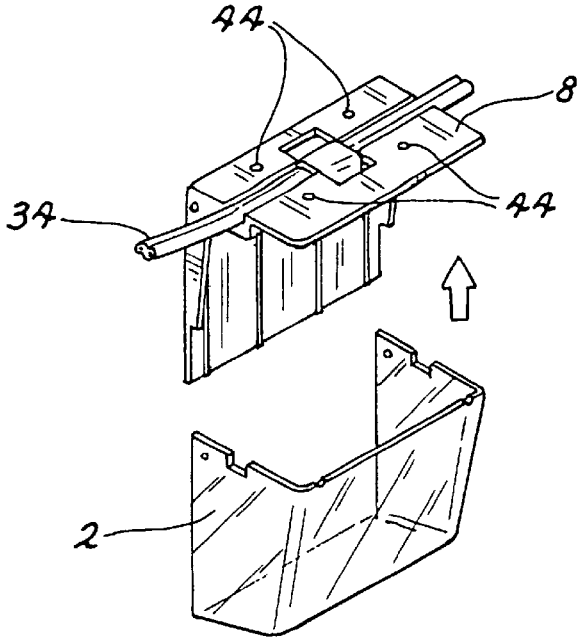
FIG. 12 is an exploded view of the backplate and lens assembly.
Figure 13:
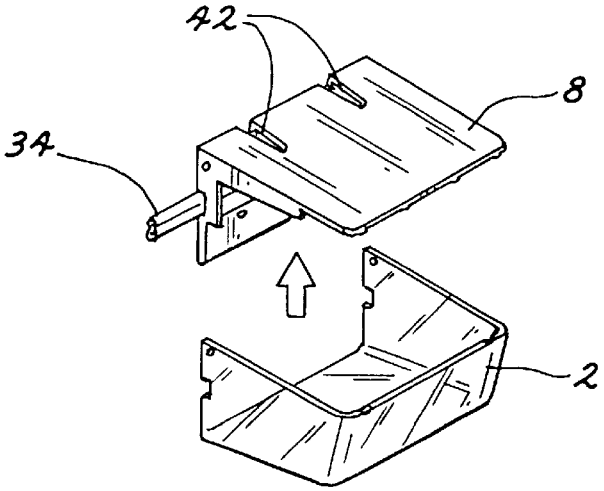
FIG. 13 is an exploded view of the backplate and lens assembly showing an alternate assembly method.
Figure 14:
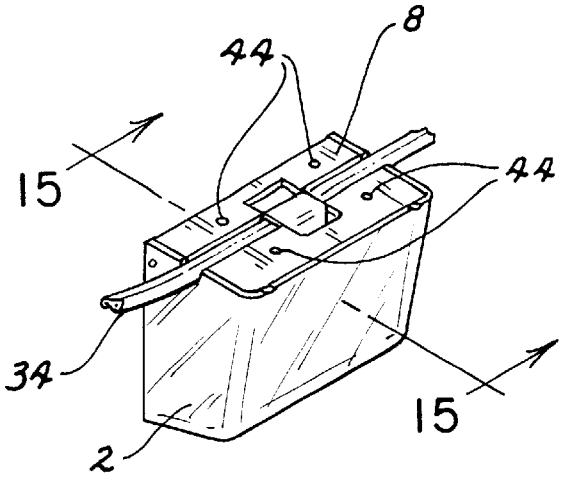
FIG. 14 is a perspective view of a fully assembled light fixture of the present invention.

Referring to the Drawing, wherein like reference numerals designate like parts and assemblies throughout the several views, FIGS. 1 and 2 show a lens 2 of the preferred light fixture. FIGS. 1 and 2 also show a breakaway cable connector 4 connected to the lens 2 via a tab 6. The lens 2, tab 6, and connector 4 are constructed of a suitable material such as polycarbonate. LEXAN 143 is one such suitable material. The lens 2 is quite transparent which permits the passage of light. FIGS. 7 and 8 show perspective views of the lens 2 after the connector 4 and tab 6 have been separated from the lens 2. The preferred embodiment lens 2 includes a series of ridges and valleys (not shown) on the inner side of the lens to aide in the diffusion of light from the lamp. Such diffuser ridges and valleys are optional and do not affect the invention herein. FIGS. 12 and 13 show the lens 2 as it is positioned prior to assembly to the backplate 8.

The cable connector 4 is connected to the lens 2 by the tab 6. The tab 6 is best shown in FIGS. 1 and 2. Tab 6 has a nominal thickness 10 of 0.080 inch and a width 12 of approximately 0.25 inch. Tab 6 also has a length 14 of approximately 0.31 inch. A notch 16 runs along the intersection of the tab 6 and the lens 2. The notch 16 is approximately 0.040 inch deep along its entire length. A notch 18 runs along the intersection of the tab 6 and the connector 4. Notch 18 is approximately 0.030 deep along its entire length. The notches 16 and 18 permit the operator to break off the cable connector 4 from the lens 2 as shown in FIGS. 7 and 8. Since notch 16 is deeper than notch 18, a typical break off sequence is the fracture of notch 16 when the operator applies force to the connector 4. FIG. 7 shows the connector 4 and tab 6 still connected to one another while the tab 6 has separated from the lens 2. FIG. 8 shows the tab 6 separated from the cable connector 4. Tab 6 and cable connector 4 are separated when the operator applies force between the two elements. The notches 16 and 18 facilitate an orderly and contained fracture between the parts so that the connector 4 and lens 2 break away cleanly from the tab 6. Once the connector 4 is broken off of the tab 6 and the lens 2, the connector 4 can be used to further assemble the entire light fixture and the tab can be discarded. Such assembly will now be discussed in detail below.

Figure 9:
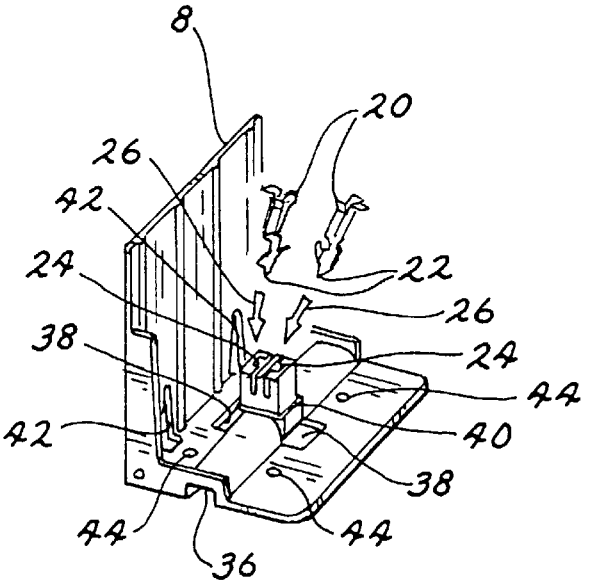
FIG. 9 is an exploded view of the backplate and lamp contacts.
Figure 10:
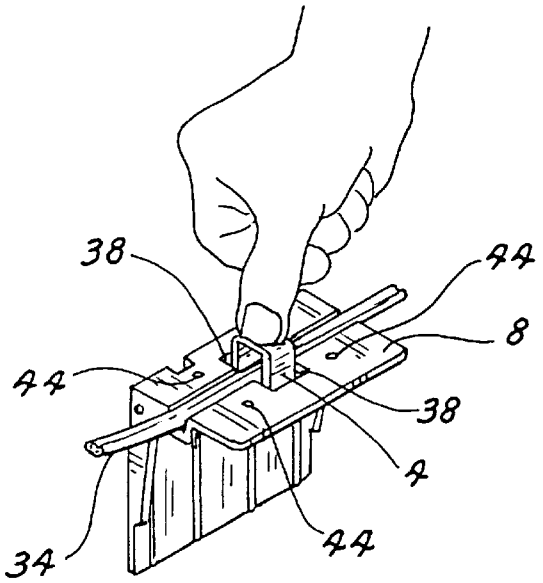
FIG. 10 is a perspective view of the backplate showing an operator installing the cable connector.
Figure 11:
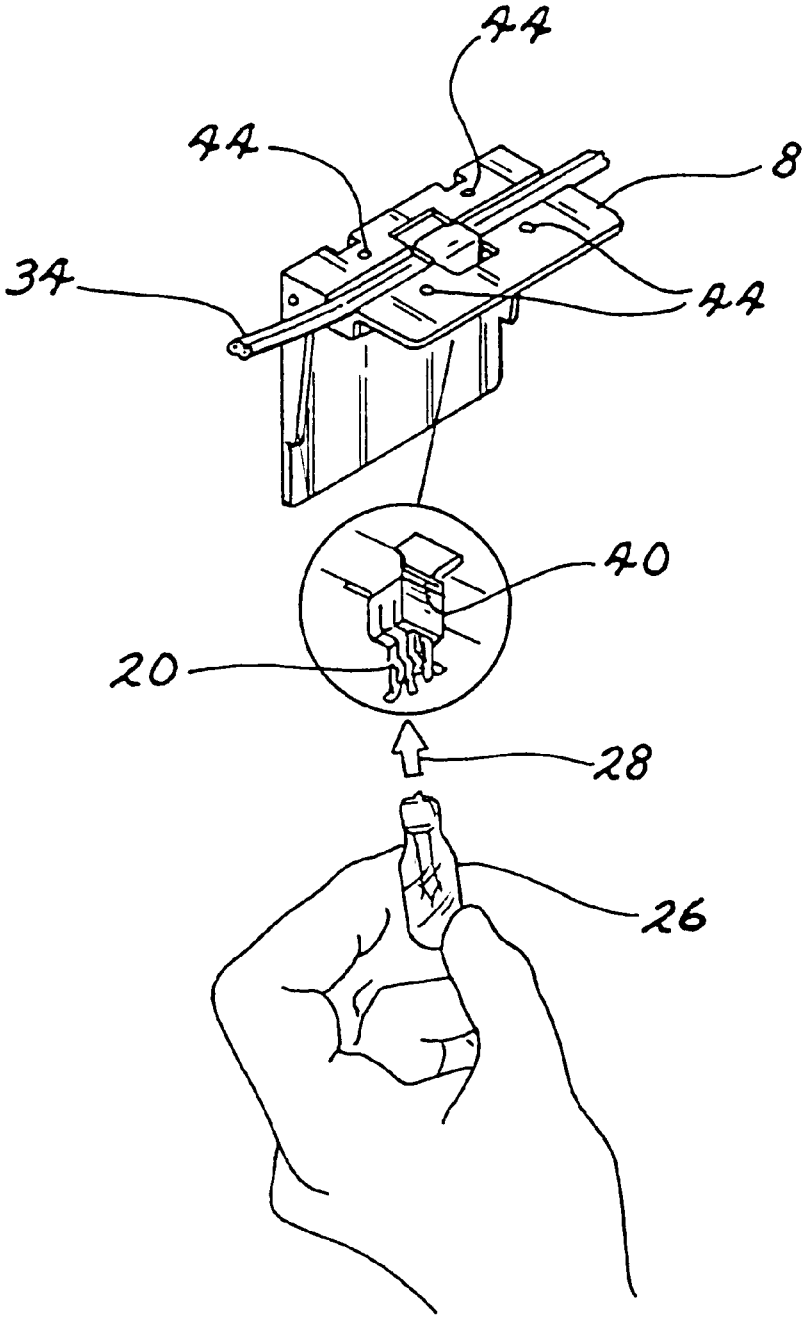
FIG. 11 is an exploded view of the backplate, lamp contacts and lamp assembly showing the operator installing the lamp.

FIGS. 9 through 15 best show the assembly of the preferred light fixture. FIG. 9 shows the insertion of the lamp contacts 20 into the backplate 8. Contacts 20 include cable piercing tips 22 which are inserted into lamp contact receptacles 24. Arrows 26 indicate the direction which lamp contacts 20 are pushed for insertion into the receptacles 24. The lamp contacts of the preferred embodiment are constructed of phosphor bronze. FIG. 11 shows the lamp contacts 20 after they have been fully inserted into the receptacles 24. FIG. 11 also shows the insertion of the lamp 26 into the lamp contacts 20. Arrow 28 shows the direction which lamp 26 must be pushed into the contacts 20. The contacts 20 electrically engage the lamp 26 and mechanically restrain the lamp 26.

Figure 5:
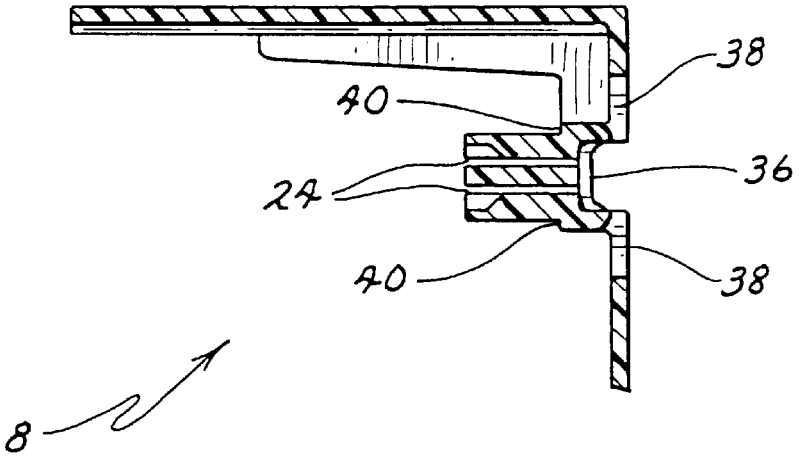
FIG. 5 is a sectional view of the backplate of FIG. 3 taken along line 5—5 thereof.
Figure 6:
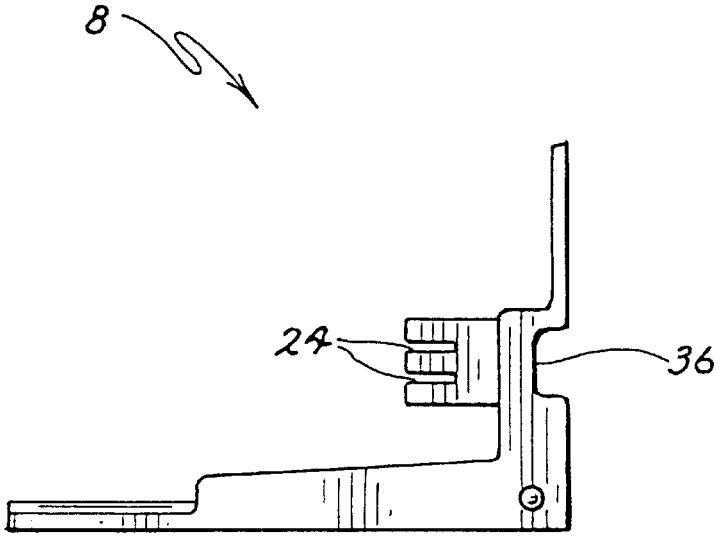
FIG. 6 is a right side elevational view of the backplate.
Figure 15:
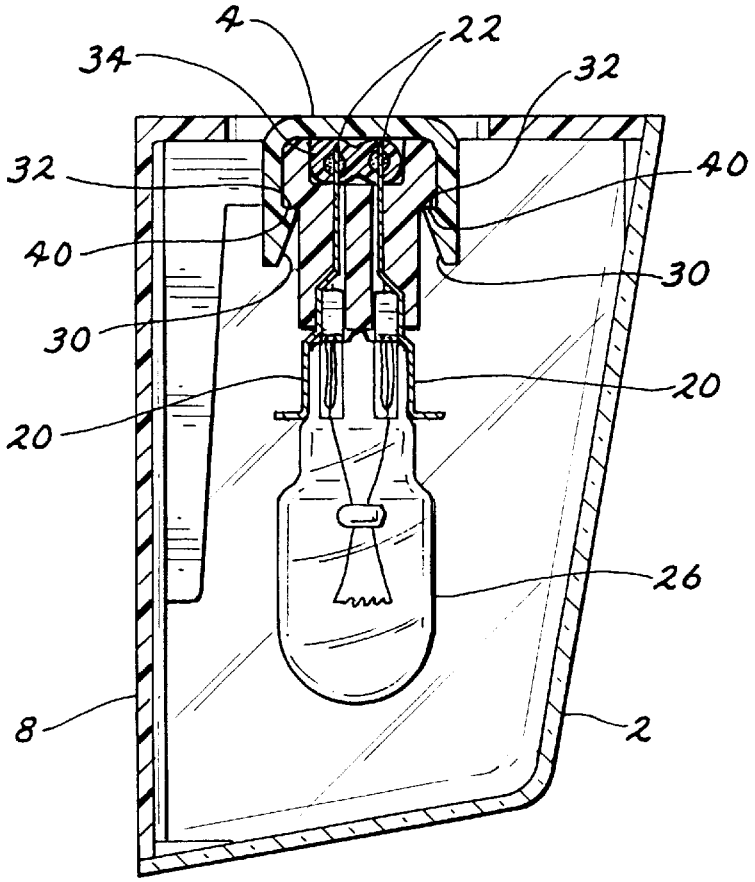
FIG. 15 is a sectional view of the light fixture of FIG. 14 taken generally along line 15—15.

The cable connector 4 is best shown in FIGS. 1, 2 and 15. The connector 4 is formed as a generally U-shaped member with a pair of barbs 30 at the ends of the legs 32. An electrical supply cable 34 is placed in the channel 36 of the backplate 8. Once the connector 4 has been broken off of the tab 6 and lens 2, the connector 4 is positioned over the base 8 as shown in FIG. 10. Cable connector 4 is then pressed downward over the supply cable 34. The barbs 30 and legs 32 of the connector 4 are aligned with the cable connector slotted receiver 38 formed in the backplate 8. The cable connector 4 is then pushed, as shown in FIG. 10, so that the barbs 30 and legs 32 descend into the receiver 38. As the cable connector 4 is pushed further into the receiver 38, the barbs 30 engage ledges 40 of the backplate 8. Ledges 40 are best shown in FIGS. 5, 9 and 11. When the barbs 30 engage the ledges 40, the cable connector 4 is locked in place. At this point, the clamping force developed between the connector 4 and the backplate 8 compresses the electrical supply cable 34 against the piercing tips 22 of the lamp contacts 20. The piercing tips 22 penetrate the insulation of the electrical supply cable 34 and contact the conductive core, thus establishing electrical contact between the electrical supply cable 34 and the lamp contacts 20. FIG. 15 shows the cable connector 4 in its fully assembled position.

FIG. 15 shows the piercing tips 22 contacting the conductive cores of the electrical supply cable 34. FIG. 15 also shows the barbs 30 of the connector 4 engaged with the ledges 40 of the backplate 8.

Figure 4:
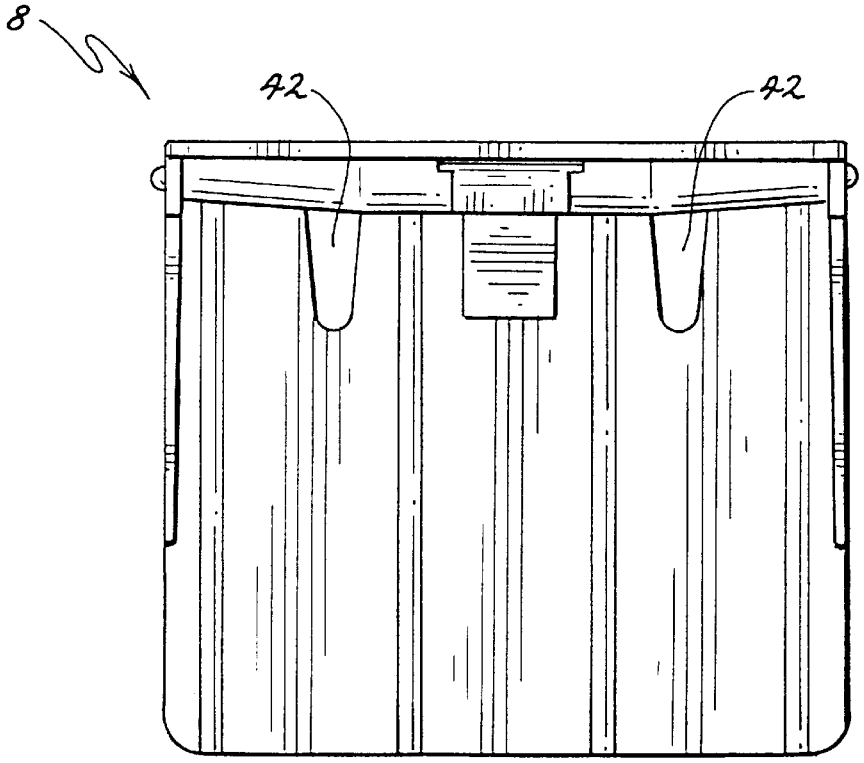
FIG. 4 is a front elevational view thereof.

Final assembly of the light fixture of the present invention is shown in FIGS. 12 and 13. FIG. 12 shows an assembly configuration where the electrical supply cable 34 is located at the top of the backplate 8. In this configuration, the backplate 8 can be mounted to a vertical surface by the insertion of screws or nails through slots 42 (shown in FIGS. 4, 9, and 13) and into the vertical mounting surface. Or, the backplate can be secured to a horizontal mounting surface by the insertion of screws or nails through holes 44 (shown in FIGS. 3, 9, 10, 11, 12 and 14) and into the horizontal mounting surface. Once the backplate 8 has been securely mounted, the lens 2 can be snapped onto the backplate 8. The lens 2 can also be easily removed from the backplate 8 for ease of replacing the lamp 26. The light fixture can also be mounted as shown in FIG. 13 so that the portion of the backplate 8 that includes the slots 42 faces upward. Mounting of the backplate 8 in such an orientation is similar to the mounting procedure as shown in and described for FIG. 12.

There will be other modifications that will be apparent to those skilled in the art. For example, the cable connector 4 could be mounted via a tab 6 to the backplate 8. Or, the light fixture could have an integral lens and backplate to which a cable connector 4 could be mounted via a breakaway tab 6. Furthermore, the electrical supply cable 34 could be an integral part of the light fixture rather than a separate component requiring assembly by the operator. In that case, the cable connector 4 would still be used to press the electrical supply cable 34 into the lamp contacts 20 to establish electrical contact. Accordingly, the scope of this invention will be limited only by the appended claims.

I claim:

1. A light fixture comprising:

a. a pair of lamp contacts operatively supported by the fixture;

b. a lamp mechanically and electrically connected to the lamp contacts;

c. an electrical supply cable for delivering electrical power to the lamp contacts and lamp;

d. a channel formed in the light fixture for accepting the electrical supply cable;

e. a breakaway cable connector integrally molded to the light fixture; and f. a cable connector receiver formed in the fixture for receiving and mechanically restraining the cable connector wherein the lamp contacts are electrically connected to the cable when the cable is positioned in the channel and the cable connector is broken off of the light fixture and snapped into the cable connector receiver.

2. The light fixture of claim 1, wherein the breakaway cable connector comprises at least one barbed leg for engaging the connector receiver.

3. The light fixture of claim 2, wherein the breakaway connector comprises a generally U-shaped element with a pair of barbed legs for engaging the connector receiver.

4. The light fixture of claim 3, wherein the cable connector is connected to the light fixture by a tab and wherein the tab breaks away from the connector or the fixture when a force exceeding a predetermined value is transmitted through the tab.

5. The light fixture of claim 4, further comprising a notch running along an intersection of the tab and the connector.

6. The light fixture of claim 4, further comprising a notch running along an intersection of the tab and the fixture.

7. A light fixture comprising:

a) a pair of lamp contacts operatively supported by the fixture;

b) a lamp mechanically and electrically connected to the lamp contacts;

c) an electrical supply cable for delivering electrical power to the lamp contacts and lamp;

d) a channel formed in the light fixture for accepting the electrical supply cable;

e) a breakaway cable connector integrally molded to the light fixture by a tab wherein the cable connector comprises a pair of barbed legs; and f) a cable connector receiver formed in the fixture for receiving and mechanically restraining the cable connector, the receiver including a pair of slots for receiving the barbed legs of the cable connector wherein the lamp contacts are electrically connected to the cable when the cable is positioned in the channel and the cable connector is broken off of the light fixture and snapped into the cable connector receiver.

8. A light fixture comprising:

a) a lamp contact supported by the fixture;

b) a lamp electrically connected to the lamp contacts;

c) an electrical supply cable for delivering electrical power to the lamp contacts and lamp;

d) a breakaway cable connector integrally molded to the light fixture by a tab; and e) a cable connector receiver formed in the fixture for receiving and mechanically restraining the cable connector;

wherein the lamp contacts are electrically connected to the cable when the cable is positioned on the light fixture and the cable connector is broken off of the light fixture and snapped into the cable connector receiver.

9. A light fixture comprising:

a) a backplate for mounting the fixture to a mounting surface;

b) a lens removably mounted to the backplate;

c) a lamp contact supported by the backplate;

d) a lamp electrically connected to the lamp contacts;

e) an electrical supply cable for delivering electrical power to the lamp contacts and lamp;

f) a breakaway cable connector integrally molded to the lens by a tab; and g) a cable connector receiver formed in the backplate for receiving and mechanically restraining the cable connector;

wherein the lamp contacts are electrically connected to the cable when the cable is positioned on the backplate and the cable connector is broken off of the lens and snapped into the cable connector receiver.

* * * * *